US012144400B2

(12) United States Patent
Johnson

(10) Patent No.: US 12,144,400 B2
(45) Date of Patent: Nov. 19, 2024

(54) SHOELACE TIGHTENING SYSTEM

(71) Applicant: Gregory Glenn Johnson, Hugo, MN (US)

(72) Inventor: Gregory Glenn Johnson, Hugo, MN (US)

(73) Assignee: Gregory Glenn Johnson, Hugo, MN (US)

( * ) Notice: Subject to any disclaimer, the term of this patent is extended or adjusted under 35 U.S.C. 154(b) by 0 days.

(21) Appl. No.: 17/935,371

(22) Filed: Sep. 26, 2022

(65) Prior Publication Data

US 2024/0099427 A1 Mar. 28, 2024

(51) Int. Cl.
*A43C 1/04* (2006.01)

(52) U.S. Cl.
CPC ..... *A43C 1/04* (2013.01)

(58) Field of Classification Search
CPC ..... A43C 1/04
See application file for complete search history.

(56) References Cited

U.S. PATENT DOCUMENTS 4,879,787 A * 11/1989 Walls ..... A43B 23/24 24/712.2
5,027,482 A * 7/1991 Torppey ..... A43C 11/1493 24/712.1
5,353,483 A * 10/1994 Louviere ..... A43C 11/1493 24/712.1
5,778,500 A * 7/1998 Illingworth ..... A43C 7/005 24/712
5,907,912 A * 6/1999 Alaimo ..... A43C 11/008 36/50.1
6,295,704 B1 10/2001 Rivas
8,844,168 B2 * 9/2014 Toraya ..... A43C 7/00 24/712
9,930,931 B2 * 4/2018 Leary ..... A43C 1/06
2003/0051374 A1 * 3/2003 Freed ..... A43C 11/008 36/50.1
2003/0100855 A1 * 5/2003 Norstrem ..... A61F 5/0111 602/65
2004/0078999 A1 * 4/2004 Freed ..... A43C 11/008 36/50.1
2007/0277398 A1 * 12/2007 Davis ..... A43B 1/0081 36/50.1
2008/0110003 A1 * 5/2008 Franzino ..... A43C 7/005 24/712.1
2013/0283639 A1 * 10/2013 Williams ..... A43C 7/02 36/83
2014/0137432 A1 * 5/2014 Eldem ..... A43B 1/0081 24/713
2014/0366340 A1 * 12/2014 Park ..... A43C 7/08 24/712.2
2016/0270482 A1 * 9/2016 Krengel ..... A41D 1/06
(Continued)

*Primary Examiner* — David M Upchurch
(74) *Attorney, Agent, or Firm* — Thompson Patent Law Offices, PC

(57) ABSTRACT

A shoelace tightening system for singlehanded tightening of a shoelace on a shoe. The shoelace tightening system includes a shoelace, a pull tab and a fastening system. The shoelace is threaded through eyelets on both sides of the shoe's throat, with a pull tab slidably secured to a continuous free length of shoelace extending between the exit eyelets. The pull tab is operable for pulling the shoelace taut with a single hand, and fastenable to the shoe upper at a location that keeps the shoelace taut.

24 Claims, 3 Drawing Sheets

(56) References Cited

U.S. PATENT DOCUMENTS

| | | | | |
|---|---|---|---|---|
| 2018/0116343 | A1* | 5/2018 | Hei | A43C 11/00 |
| 2018/0140451 | A1* | 5/2018 | Gaylord | A61F 5/0111 |
| 2019/0343231 | A1* | 11/2019 | Auyang | A43C 1/003 |
| 2020/0068996 | A1* | 3/2020 | Halahmi | A43C 11/24 |
| 2021/0015197 | A1* | 1/2021 | White | A43C 11/006 |
| 2021/0112924 | A1* | 4/2021 | Hopkins | A43B 3/246 |
| 2021/0153605 | A1* | 5/2021 | Hopkins | A43C 11/008 |
| 2022/0225736 | A1* | 7/2022 | Kagami | A43C 1/003 |

* cited by examiner

SHOELACE TIGHTENING SYSTEM

FIELD OF THE INVENTION

The present invention relates to lace-up shoes and systems for facilitating tightening and releasing of the shoelaces on lace-up shoes.

BACKGROUND OF THE INVENTION

Lace-up shoes continue to be the most popular type of shoe. Tightening and release of the laces on lace-up shoes is a daily, often bothersome task, particularly for the aged and those in poor health.

Hence, a substantial need exists for a shoelace tightening system that facilitates quick and easy tightening and release of the laces without adversely impacting normal function and performance of the shoe and/or the laces.

SUMMARY OF THE INVENTION

A first aspect of the invention is a shoelace tightening system for singlehanded tightening of a shoelace on a shoe. The shoelace tightening system includes at least a shoelace, a pull tab and a fastening system.

In a first embodiment of the system, (A) the shoelace is laced through a first series of eyelets through a medial facing on the shoe and a second series of eyelets through a lateral facing on the shoe, with the laced shoelace exiting through an exit eyelet on the medial facing proximate a topline of the shoe and an exit eyelet on the lateral facing proximate the topline of the shoe, (B) a continuous free length of shoelace is provided between the exit eyelet on the medial facing and the exit eyelet on the lateral facing, (C) the pull tab is slidably engaged to the free length of shoelace, whereby the pull tab is operable for sliding along the length of the shoelace, and (D) the fastening system is operable for releasably securing the pull tab to the shoe with the shoelace pulled taut.

In a second embodiment of the system, (A) the shoelace is laced through a first series of eyelets through a medial facing on the shoe and a second series of eyelets through a lateral facing on the shoe, (B) a continuous free length of shoelace is provided after exiting the first and second series of eyelets, (C) the pull tab engages the free length of shoelace, and (D) the fastening system is operable for releasably securing the pull tab to the shoe with the shoelace pulled taut, and includes at least hook and loop tape having a first portion affixed to the pull tab and a second portion affixed to the shoe upper and extending along a collar of the shoe proximate a topline of the shoe.

In a third embodiment of the system, (A) the shoelace is laced through a first series of eyelets through a medial facing on the shoe and a second series of eyelets through a lateral facing on the shoe, (B) the laced shoelace has a free first end length and a free second end length exiting the first and second series of eyelets, (C) the pull tab engages and joins the ends of the free first end length and free second end length of shoelace, and (D) the fastening system is operable for releasably securing the pull tab to the shoe with the shoelace pulled taut, and includes at least hook and loop tape having a first portion affixed to the pull tab and a second portion affixed to the shoe upper and extending along a collar of the shoe proximate a topline of the shoe.

A second aspect of the invention is a shoe equipped with the shoelace tightening system of the first aspect of the invention.

A third aspect of the invention is a method of single handedly donning and tightening the shoe of the second aspect of the invention. The method includes (i) obtaining a shoe in accordance with the second aspect of the invention, (ii) donning the shoe, (iii) pulling the pull tab with a single hand until the shoelace is taut, while allowing the pull tab to inherently slide along the shoelace to achieve balanced tensioning of both the length of free shoelace extending from the pull tab to the first exit eyelet and the length of free shoelace extending from the pull tab to the second exit eyelet, and (iv) fastening the pull tab onto the shoe with the shoelace pulled taut.

DETAILED DESCRIPTION OF AN ILLUSTRATIVE EMBODIMENT OF THE INVENTION

Definitions

Figure 1:
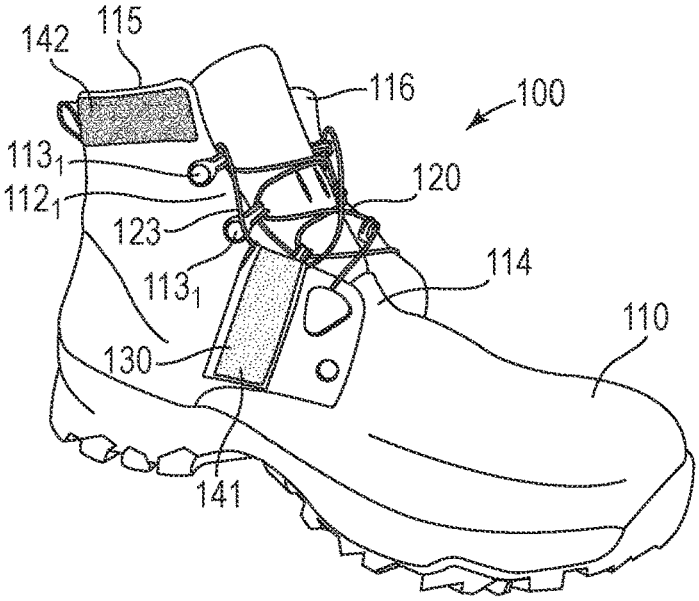
FIG. 1 is a perspective medial-anterior view of one embodiment of a left boot in accordance with the present invention.

As utilized herein, including the claims, the phrase "free length of shoelace" refers to a length of laced shoelace which does not pass through another eyelet or similar element on the shoe.

As utilized herein, including the claims, the phrase "releasably securing" means the ability to repeatedly and nondestructively secure and release.

Nomenclature Table

| REF. NO. | NAME |
|---|---|
| 100 | Shoelace Tightening System |
| 110 | Shoe |
| 111 | Throat |
| $112_1$ | Medial Facing |
| $112_2$ | Lateral Facing |
| $113_1$ | Eyelets on Medial Facing |
| $113_2$ | Eyelets on Lateral Facing |
| $113_{EXIT}$ | Exit Eyelet |
| 114 | Vamp |
| 115 | Topline |
| 116 | Collar |
| 120 | Shoelace |
| 121 | First End of Shoelace |
| 122 | Second End of Shoelace |
| 123 | Free Length of Shoelace |
| 130 | Pull Tab |
| 140 | Fastening System |
| 141 | First Fastener Half |
| 142 | Second Fastener Half |

Construction

The invention is a shoelace tightening system 100 and a shoe 110 equipped with the shoelace tightening system 100.

The shoelace tightening system 100 allows singlehanded tightening of a shoelace 120 on a shoe 110. The shoelace tightening system 100 includes at least a shoelace 120, a pull tab 130 and a fastening system 140.

The shoe 110 can be substantially any conventional lace-up shoe 110 including specifically but not exclusively dress shoes, boat shoes, sneakers, athletic shoes, tennis shoes, high top shoes, hiking boots, work boots, hunting boots, snow boots, snowboarding boots, duck boots, combat boots, etc.

The shoelace 120 is laced through eyelets 113 and across the throat 111 of the shoe 110 in a conventional manner.

Figure 2:
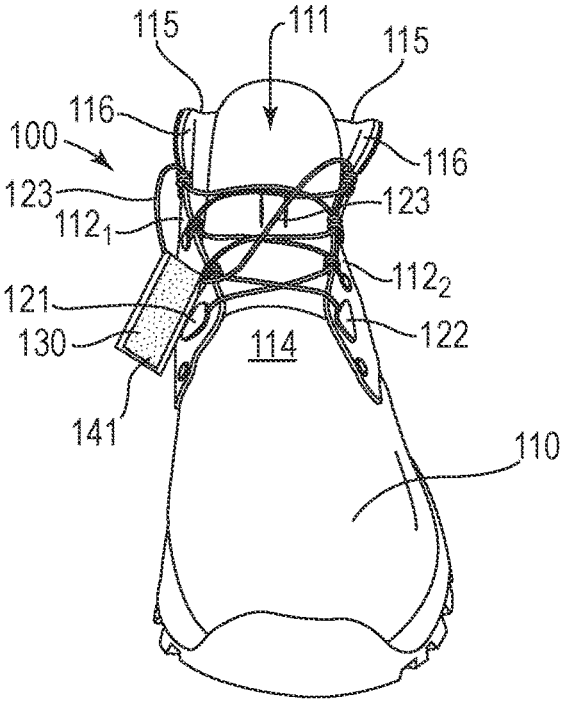
FIG. 2 is a perspective anterior view of the left boot depicted in FIG. 1.
Figure 3:
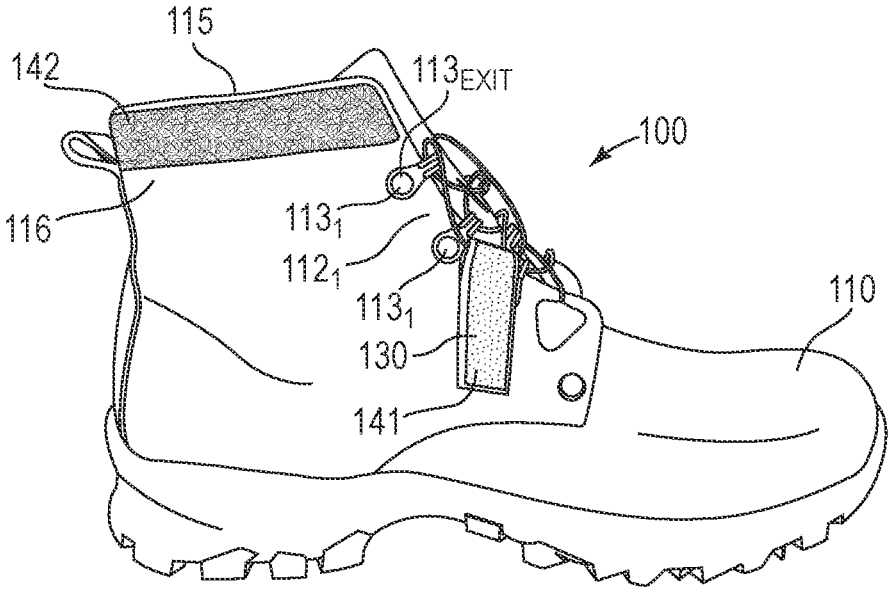
FIG. 3 is a perspective medial view of the left boot depicted in FIG. 1.
Figure 4:
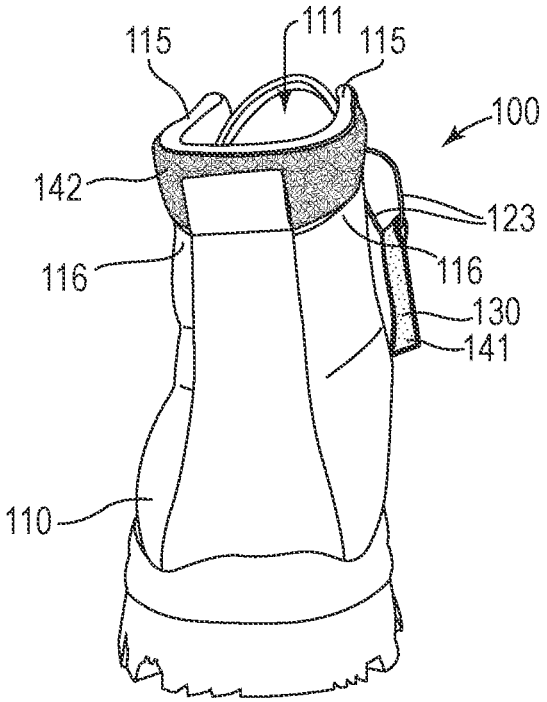
FIG. 4 is a perspective posterior back view of the left boot depicted in FIG. 1.
Figure 5:
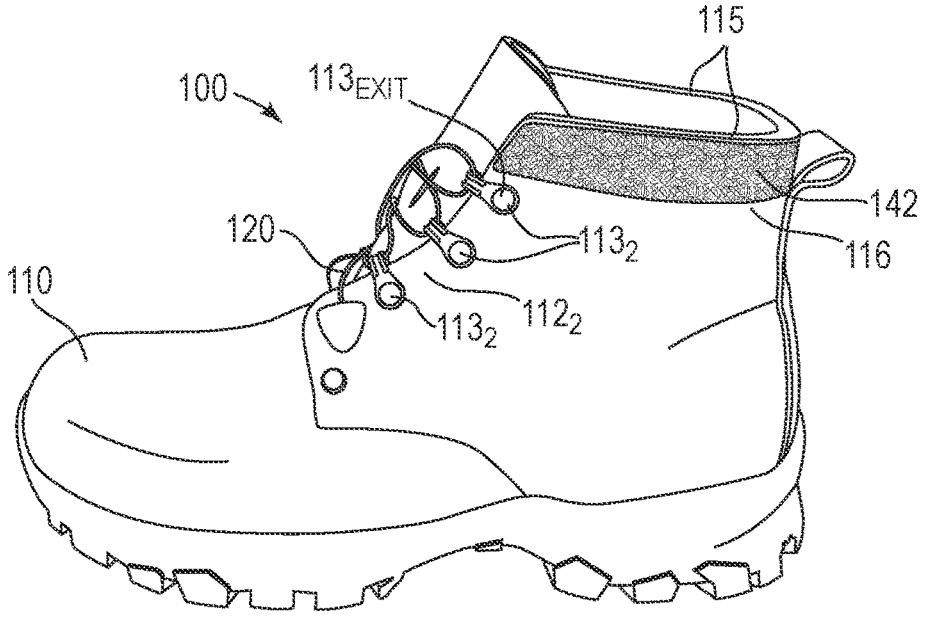
FIG. 5 is a perspective lateral view of the left boot depicted in FIG. 1.
Figure 6:
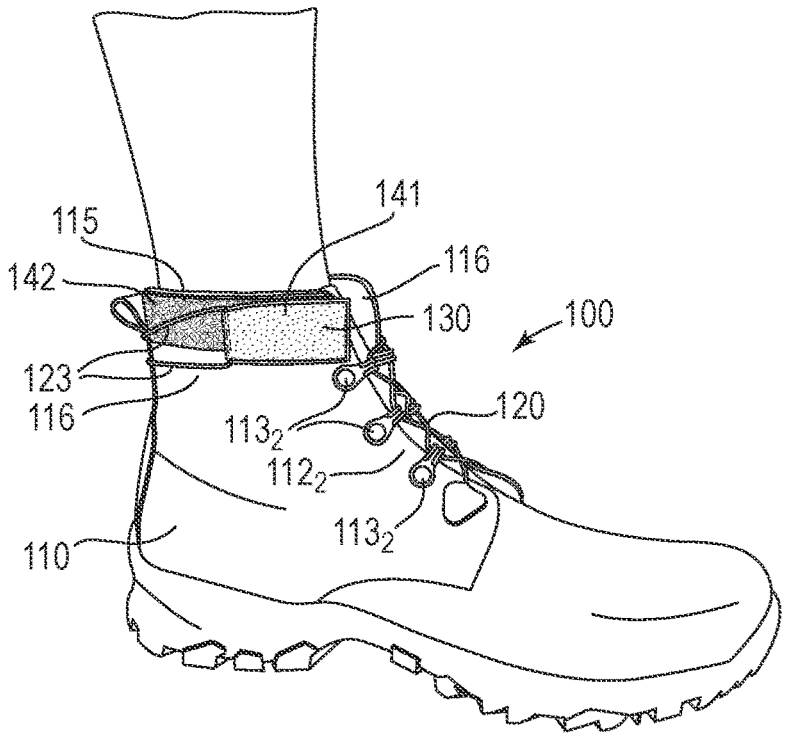
FIG. 6 is a perspective lateral view of the left boot depicted in FIG. 1 worn on a left foot with the shoelace drawn taut and the fastener fastened.

Referring to FIG. 2, a first embodiment of the shoelace tightening system 100 has a first series of eyelets $\mathbf{113}_1$ running along the medial side facing $\mathbf{112}_1$ of the shoe 110 and a second series of eyelets $\mathbf{113}_2$ running along the lateral side facing $\mathbf{112}_2$ of the shoe 110, with the shoelace 120 exiting through an exit eyelet $\mathbf{113}_{EXIT}$ on the medial side facing $\mathbf{112}_1$ proximate a topline 115 of the shoe 110 and an exit eyelet $\mathbf{113}_{EXIT}$ on the lateral side facing $\mathbf{112}_2$ proximate the topline 115 of the shoe 110, with a continuous free length of shoelace 123 extending between the exit eyelet $\mathbf{113}_{EXIT}$ on the medial side facing $\mathbf{112}_1$ and the exit eyelet $\mathbf{113}_{EXIT}$ on the lateral side facing $\mathbf{112}_2$. The ends 121 and 122 of the shoelace 120 can be fastened to the shoe upper (unnumbered) or to one another proximate the vamp 114 of the shoe 110 before the shoelace 120 is threaded through any of the eyelets $\mathbf{113}_1$ and $\mathbf{113}_2$, or the ends 121 and 122 can be secured to one another after the shoelace 120 exits both of the exit eyelets $\mathbf{113}_{EXIT}$.

Referring to FIGS. 1-4 and 6, the pull tab 130 on the first embodiment is slidably engaged to the free length of shoelace 123, whereby the pull tab 130 is operable for sliding along the length of the free length of shoelace 123. Sliding of the pull tab 130 along the free length of shoelace 123 allows the pull tab 130 to inherently adjust its position along the length of the shoelace 120 to achieve balanced tensioning of both the free length of shoelace 123 extending from the pull tab 130 to the exit eyelet $\mathbf{113}_{EXIT}$ on the medial side facing $\mathbf{112}_1$ and the free length of shoelace 123 extending from the pull tab 130 to the exit eyelet $\mathbf{113}_{EXIT}$ on the lateral side facing $\mathbf{112}_2$.

Referring to FIGS. 1 and 3-6, the fastening system 140 is operable for releasably securing the pull tab 130 to the shoe 110 with the shoelace 120 pulled taut. The fastening system 140 can be selected from any conventional fastening device capable of allowing fastening at multiple spaced locations for accommodating various sized feet and preferred tensioned strengths, including specifically but not exclusively snaps with a snap half on the pull tab 130 and a series of mating snap halves spaced along the shoe 110 or vice-versa, hook and loop tape of appropriate lengths with a first portion 141 on the pull tab 130, preferably on both sides of the pull tab 130 to permit clockwise and counterclockwise wrapping of the shoelace 120 around the collar 116, and a mating portion 142 on the shoe 110, a clasp or S-hook on the pull tab 130 with a series of spaced rings on the shoe 110 or vice-versa, etc.

The portion of the fastening system 140 secured to the shoe 110 can be secured along the collar 116 of the shoe around the opening in the top of the shoe 110, preferably extending in a continuous albeit perhaps patterned fashion along the collar 116 from proximate the medial facing $\mathbf{112}_1$ to proximate the lateral facing $\mathbf{112}_2$.

A second embodiment of the shoelace tightening system 100 has the shoelace 120 laced across the throat 111 of the shoe 110 through the first series of eyelets $\mathbf{113}_1$ running along the medial side facing $\mathbf{112}_1$ of the shoe 110 and the second series of eyelets $\mathbf{113}_2$ running along the lateral side facing $\mathbf{112}_2$ of the shoe 110, with a continuous free length of shoelace 123 provided after exiting the first $\mathbf{113}_1$ and second $\mathbf{113}_2$ series of eyelets. The pull tab 130 and fastening system 140 on the second embodiment remain as described for the first embodiment.

A third embodiment of the shoelace tightening system 100 system has the shoelace 120 laced across the throat 111 of the shoe 110 through the first series of eyelets $\mathbf{113}_1$ running along the medial side facing $\mathbf{112}_1$ of the shoe 110 and the second series of eyelets $\mathbf{113}_2$ running along the lateral side facing $\mathbf{112}_2$ of the shoe 110, with free first and second end lengths 121 and 122 of the shoelace 120 exiting the first $\mathbf{113}_1$ and second $\mathbf{113}_2$ series of eyelets. The pull tab 130 does not slidably engage the shoelace 120, but rather engages and joins the ends of the free first 121 and second 122 end lengths of the shoelace 120.

Method of Using

A shoe 110 equipped with the shoelace tightening system 100 having a sliding pull tab 130 can be single handedly donned and tightened by (i) donning the shoe 110, (ii) pulling the pull tab 130 with a single hand until the shoelace 120 is taut, while allowing the pull tab 130 to inherently slide along the shoelace 120 to achieve balanced tensioning of both the free length of shoelace 123 extending from the pull tab 130 to the first exit eyelet $\mathbf{113}_1$ and the free length of shoelace 123 extending from the pull tab 130 to the second exit eyelet $\mathbf{113}_2$, and (iii) fastening the pull tab 130 onto the shoe 110 using the fastening system 140 with the shoelace 120 pulled taut. The shoe 110 can be doffed by reversing the process (i.e., detach the pull tab 130 from the shoe 110 to release the tension on the shoelace 120, grip and pull downward on the heel (not numbered) of the shoe 110 resulting in separation of the loosened medial and lateral facings $\mathbf{112}_1$ and $\mathbf{112}_2$ and removal of the foot from the shoe 110).

I claim:

1. A shoelace tightening system for singlehanded tightening of a shoelace on a shoe, the system comprising:

(a) a shoelace laced through a first series of eyelets through a medial facing on the shoe and a second series of eyelets through a lateral facing on the shoe, the laced shoelace exiting through an exit eyelet on the medial facing proximate a topline of the shoe and an exit eyelet on the lateral facing proximate the topline of the shoe, with a continuous free length of the shoelace between the exit eyelet on the medial facing and the exit eyelet on the lateral facing;

(b) a pull tab slidably engaging the continuous free length of the shoelace whereby the pull tab is configured to slide along a length of the shoelace during tightening; and, (c) a fastening system operable for releasably securing the pull tab to the shoe with the shoelace pulled taut by the pull tab.

2. The shoelace tightening system of claim 1 wherein the shoe is a boot configured and arranged to extend over an ankle of a wearer.

3. The shoelace tightening system of claim 1 wherein the shoe has a vamp and the shoelace has first and second ends fastened to the shoe upper proximate the vamp of the shoe.

4. The shoelace tightening system of claim 1 wherein the shoe has a vamp and the shoelace has first and second ends fastened to one another proximate the vamp of the shoe.

5. The shoelace tightening system of claim 1 wherein the pull tab is configured and arranged to be pulled so as to tighten the shoelace and fastened to the shoe using a single hand.

6. The shoelace tightening system of claim 1 wherein the shoe has an upper and the fastening system is hook and loop tape having a first portion affixed to the pull tab and a second portion affixed to the shoe upper.

7. The shoelace tightening system of claim 6 wherein the shoe has a collar defining the topline, and the second portion of the hook and loop tape extends along the collar of the shoe proximate the topline of the shoe.

8. The shoelace tightening system of claim 7 wherein the second portion of the hook and loop tape extends continuously along the collar of the shoe proximate the topline of the shoe from proximate the medial facing to proximate the lateral facing.

9. A singlehanded tightenable shoe, comprising:

(a) a shoe having (i) an upper, (ii) a vamp, (iii) a collar defining a topline, (iv) a medial facing with a first series of eyelets therethrough including a first exit eyelet proximate the topline of the shoe, and (v) a lateral facing with a second series of eyelets therethrough including a second exit eyelet proximate the topline of the shoe, and (b) a shoelace tightening system, including at least:

(i) a shoelace laced through the first and second series of eyelets on the shoe, the laced shoelace exiting through the first and second exit eyelets with a continuous free length of the shoelace between the first and second exit eyelets, (ii) a pull tab slidably engaging the continuous free length of the shoelace whereby the pull tab is configured to slide along a length of the shoelace during tightening, and (iii) a fastening system operable for releasably securing the pull tab to the shoe with the shoelace pulled taut by the pull tab.

10. The shoe of claim 9 wherein the shoe is a boot configured and arranged to extend over an ankle of a wearer.

11. The shoe of claim 9 wherein the shoelace has first and second ends fastened to the shoe upper proximate the vamp of the shoe.

12. The shoe of claim 9 wherein the shoelace has first and second ends fastened to one another proximate the vamp of the shoe.

13. The shoe of claim 9 wherein the pull tab is configured and arranged to be pulled so as to tighten the shoelace and fastened to the shoe using a single hand.

14. The shoe of claim 9 wherein the fastening system is hook and loop tape having a first portion affixed to the pull tab and a second portion affixed to the shoe upper.

15. The shoe of claim 14 wherein the second portion of the hook and loop tape extends along the collar of the shoe proximate the topline of the shoe.

16. The shoe of claim 15 wherein the second portion of the hook and loop tape extends continuously along the collar of the shoe proximate the topline of the shoe from proximate the medial facing to proximate the lateral facing.

17. A method of single handedly donning and tightening a laced shoe, comprising the steps of:

(a) obtaining a shoe in accordance with claim 9, (b) donning the shoe, (c) pulling the pull tab with a single hand until the shoelace is taut, while allowing the pull tab to inherently slide along the shoelace to achieve balanced tensioning of both the length of free shoelace extending from the pull tab to the first exit eyelet and the length of free shoelace extending from the pull tab to the second exit eyelet, and (d) fastening the pull tab onto the shoe with the shoelace pulled taut.

18. A method of single handedly donning and tightening a laced shoe, comprising the steps of:

(a) obtaining a shoe in accordance with claim 14, (b) donning the shoe, (c) pulling the pull tab with a single hand until the shoelace is taut, while allowing the pull tab to inherently slide along the shoelace to achieve balanced tensioning of both the length of free shoelace extending from the pull tab to the first exit eyelet and the length of free shoelace extending from the pull tab to the second exit eyelet, and (d) fastening the pull tab onto the shoe with the shoelace pulled taut.

19. A method of single handedly donning and tightening a laced shoe, comprising the steps of:

(a) obtaining a shoe in accordance with claim 15, (b) donning the shoe, (c) pulling the pull tab with a single hand until the shoelace is taut, while allowing the pull tab to inherently slide along the shoelace to achieve balanced tensioning of both the length of free shoelace extending from the pull tab to the first exit eyelet and the length of free shoelace extending from the pull tab to the second exit eyelet, and (d) fastening the pull tab onto the shoe with the shoelace pulled taut.

20. A method of single handedly donning and tightening a laced shoe, comprising the steps of:

(a) obtaining a shoe in accordance with claim 16, (b) donning the shoe, (c) pulling the pull tab with a single hand until the shoelace is taut, while allowing the pull tab to inherently slide along the shoelace to achieve balanced tensioning of both the length of free shoelace extending from the pull tab to the first exit eyelet and the length of free shoelace extending from the pull tab to the second exit eyelet, and (d) fastening the pull tab onto the shoe with the shoelace pulled taut.

21. A shoelace tightening system for singlehanded tightening of a shoelace on a shoe, the system comprising:

(a) a shoelace laced through a first series of eyelets through a medial facing on the shoe and a second series of eyelets through a lateral facing on the shoe, the laced shoelace having a continuous free length of shoelace after exiting the first and second series of eyelets, (b) a pull tab engaging the continuous free length of shoelace and configured to slide along a length of the shoelace during tightening, and (c) a fastening system operable for releasably securing the pull tab to the shoe with the shoelace pulled taut by the pull tab, the fastening system including at least hook and loop tape having a first portion affixed to the pull tab and a second portion affixed to an upper of the shoe and extending along a collar of the shoe proximate a topline of the shoe.

22. The shoelace tightening system of claim 21 wherein the second portion of the hook and loop tape extends continuously along the collar of the shoe proximate the topline of the shoe from proximate the medial facing to proximate the lateral facing.

23. A shoelace tightening system for singlehanded tightening of a shoelace on a shoe, the system comprising:

(a) a shoelace laced through a first series of eyelets through a medial facing on the shoe and a second series of eyelets through a lateral facing on the shoe, the laced shoelace having a free first end length and a free second end length exiting the first and second series of eyelets, (b) a pull tab engaging and joining the ends of the free first end length and the free second end length of the shoelace, and is configured to, during tightening, pull a length of the shoelace until the shoelace is taut, and (c) a fastening system operable for releasably securing the pull tab to the shoe with the shoelace pulled taut by the pull tab, the fastening system including at least hook and loop tape having a first portion affixed to the pull tab and a second portion affixed to an upper of the shoe and extending along a collar of the shoe proximate a topline of the shoe.

24. The shoelace tightening system of claim 23 wherein the second portion of the hook and loop tape extends continuously along the collar of the shoe proximate the topline of the shoe from proximate the medial facing to proximate the lateral facing.

* * * * *